US007938752B1

(12) United States Patent
Wang

(10) Patent No.: US 7,938,752 B1
(45) Date of Patent: May 10, 2011

(54) PORTABLE OPERATION CONTROL PANEL STRUCTURE OF A SPORT EQUIPMENT

(76) Inventor: Leao Wang, Taiping (TW)

( * ) Notice: Subject to any disclaimer, the term of this patent is extended or adjusted under 35 U.S.C. 154(b) by 0 days.

(21) Appl. No.: 12/983,875

(22) Filed: Jan. 3, 2011

(51) Int. Cl.
*A63B 71/00* (2006.01)

(52) U.S. Cl. ..... 482/4; 482/1; 482/8; 482/9; 482/901; 434/247

(58) Field of Classification Search ..... 482/1–9, 482/900–902; 434/247
See application file for complete search history.

(56) References Cited

U.S. PATENT DOCUMENTS 7,070,539 B2 * 7/2006 Brown et al. ..... 482/8
7,670,263 B2 * 3/2010 Ellis et al. ..... 482/8
7,717,827 B2 * 5/2010 Kurunmaki et al. ..... 482/8
* cited by examiner

*Primary Examiner* — Glenn Richman

(57) ABSTRACT

The present invention relates to a portable operation control panel structure of a sport equipment comprising a portable electronic device with a built-in driver program including an exercise plan and an operating sport equipment for executing basic operation controls of the operating sport equipment and connecting a fixed electronic control panel of the portable electronic device; and an operating sport equipment. A user can input basic data parameters into the portable electronic device anytime and use the built-in exercise plan program to set a user's exclusive recommended fitness schedule, such that after the fixed electronic control panel is connected, the portable electronic device controls the operating sport equipment to carry out the recommended fitness schedule, and then the portable electronic device records the whole course of the exercise process and update related personal parameter to set another recommended fitness schedule for an exercise next time.

3 Claims, 5 Drawing Sheets

PORTABLE OPERATION CONTROL PANEL STRUCTURE OF A SPORT EQUIPMENT

BACKGROUND OF THE INVENTION

1. Fields of the Invention

The present invention relates to a portable operation control panel of a sport equipment, and more particularly to a portable electronic device for inputting and recording personal physiological conditions and diet conditions (which are converted into calorie parameters) in order to take care of an individual exclusively, and planning a personal exclusive recommended fitness schedule by a built-in program. Moreover, a fixed electronic control panel installed to an operating sport equipment is provided for carrying out the recommended fitness schedule and recording detailed heat consumption and related physiological changes after the exercise takes place. Thereafter, a new recommended fitness schedule can be set according to new parameters.

2. Description of the Related Art

As known, many indoor electric fitness and sport equipments such as treadmills, exercise bikes, steppers, and elliptical trainers come with a fixed electronic control panel installed thereon and provided for the purpose of driving and controlling the sport equipment (such as controlling the resistance and speed of an exercise). Some manufacturers also install a built-in program including specific recommended fitness schedules to the fixed electronic control panel, such that users can select the inputted physical conditions and physiological parameters (such as height, age, sex and body weight) according to personal needs freely, in hope of satisfying a user's exercise and fitness requirements. Therefore, the operating sport equipment can have the so-called smart functions. In other words, users can do exercise from a lower level to a higher level of difficulty, and the fitness and sport equipments can provide an incremental exercise flow.

Since the fixed electronic control panel is generally installed and fixed onto single operating sport equipment, therefore, users cannot select options from the operating sport equipment, but they can set an exercise plan/management from the sport equipment step by step. When a different option of the sport equipment is selected and used, all records have to be entered and executed again. Obviously, such application of the sport equipment is inconvenient. Furthermore, users are forced to do exercise on the same operating sport equipment, and thus the users will become bored and loose the willingness of using the sport equipment easily.

In addition, some of the user personal basic data and parameters such as changes of physical and physiological conditions caused by diseases, surgical operations or injuries are variables. In addition, the body weight, blood pressure and daily diet level have substantial differences, so that the personal basic data inputted and recorded in several days or months ago are not necessarily in compliance with the present personal physiological and physical conditions. Therefore, the recommended fitness schedule planned and arranged through the fixed electronic control panel may no longer meet the personal requirements anymore. Obviously, the design of the conventional electronic control panel has drawbacks and requires improvements.

SUMMARY OF THE INVENTION

In view of the shortcomings of the prior art, the inventor of the present invention based on years of experience in the related industry to conduct extensive researches and experiments, and finally developed an electronic operation control panel structure of a sport equipment in accordance with the present invention, such that present popular portable electronic devices (including smart phones, personal digital assistants (PDAs), notebook computers, electronic books, I-Pads, and other personal mobile devices) can download an exercise plan/management program specified by the present invention and provided for users to record all of their personal related physiological parameters and diet conditions (and automatically convert the parameters and conditions into calories), so as to update the recommended fitness schedule anytime. With the originally fixed electronic control panel installed on the sport equipment, the sport equipment can carry out the recommended fitness schedule while recording, rescheduling and managing the fitness schedule according to exclusive fitness recommendations and meet the user requirements. The above-mentioned is the object of the invention.

According to the invention, a portable operation control panel structure of a sport equipment comprises a portable electronic device with a built-in driver program including an exercise plan and an operating sport equipment for executing basic operation controls of the operating sport equipment and connecting a fixed electronic control panel of the portable electronic device; and an operating sport equipment. A user can input basic data parameters into the portable electronic device anytime and use the built-in exercise plan program to set a user's exclusive recommended fitness schedule, such that after the fixed electronic control panel is connected, the portable electronic device controls the operating sport equipment to carry out the recommended fitness schedule, and then the portable electronic device records the whole course of the exercise process and update related personal parameter to set another recommended fitness schedule for an exercise next time.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
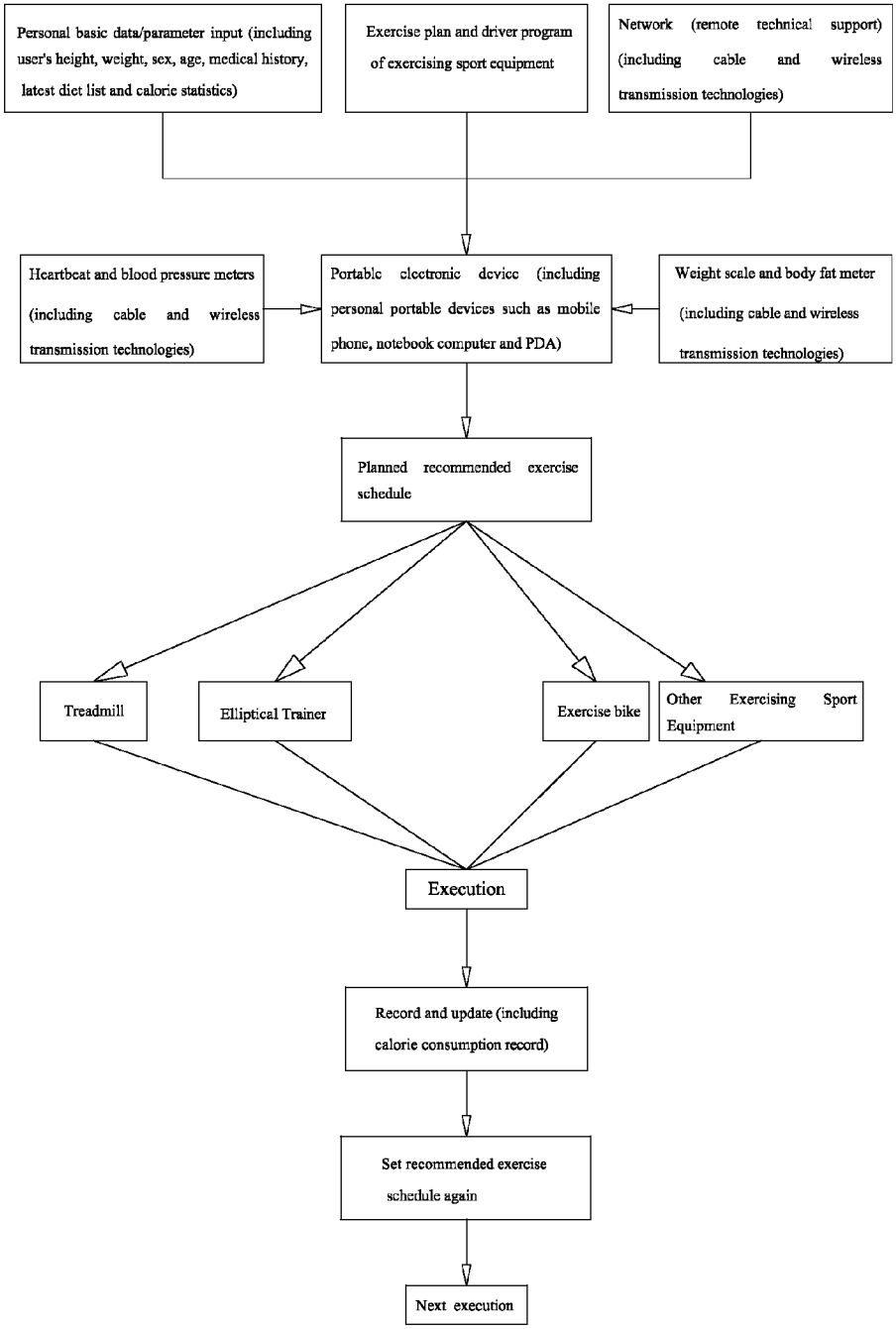
FIG. 1 is a flow chart of basic operation controls of the present invention.

With reference to FIG. 1 for a flow chart of basic operation controls of the present invention, an exercise plan and a driver program of a sport equipment are built into a portable electronic device, and personal basic data and food lists are inputted by users, and a network supported by cable and wireless technologies (such as Bluetooth and Wi-Fi, etc) is used for inputting information including a personal latest medication condition, medical order, medical history, heartbeat, blood pressure, body weight, body fat, and sleep condition are entered, so that the built-in program can plan a recommended fitness schedule which is suitable for a specific individual according to the parameters. After the network is connected to a fixed electronic control panel of an exercising equipment (such as a treadmill, an elliptical trainer, and an exercise bike, etc) via a cable or wireless transmission, a user can control the sport equipment through the portable electronic device to carry out the recommended fitness schedule. In the meantime, the whole course and conditions of the exercise are recorded anytime and the parameters (such as calorie consumption) are updated, and a new recommended fitness schedule can be set according to the new parameters and provided as a user's reference for the next stage of exercise.

Figure 2:
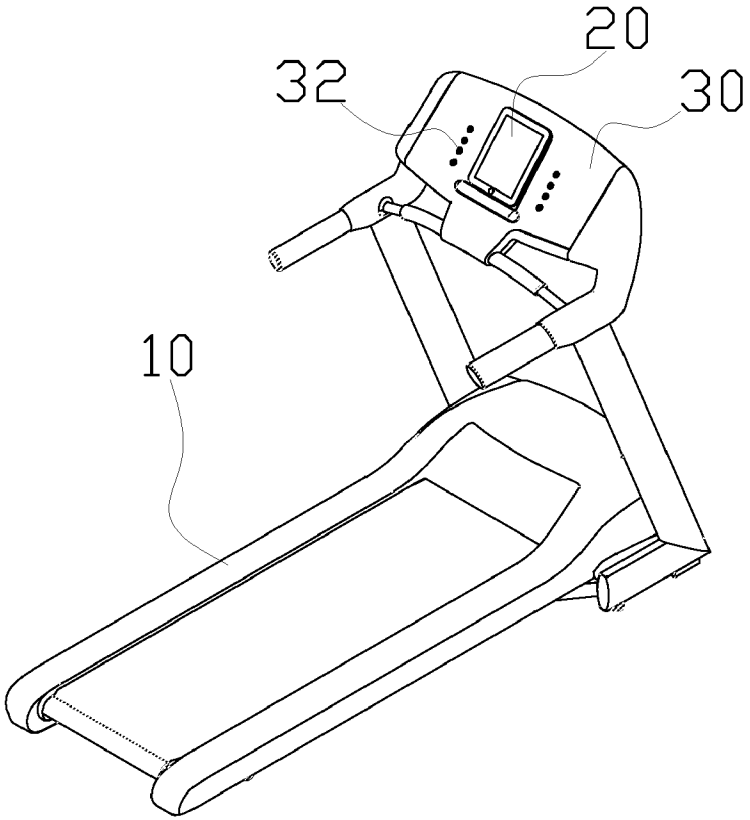
FIG. 2 is a schematic view of a portable electronic device installed to a fixed electronic control panel of an electric treadmill in accordance with a preferred embodiment of the present invention.
Figure 3:
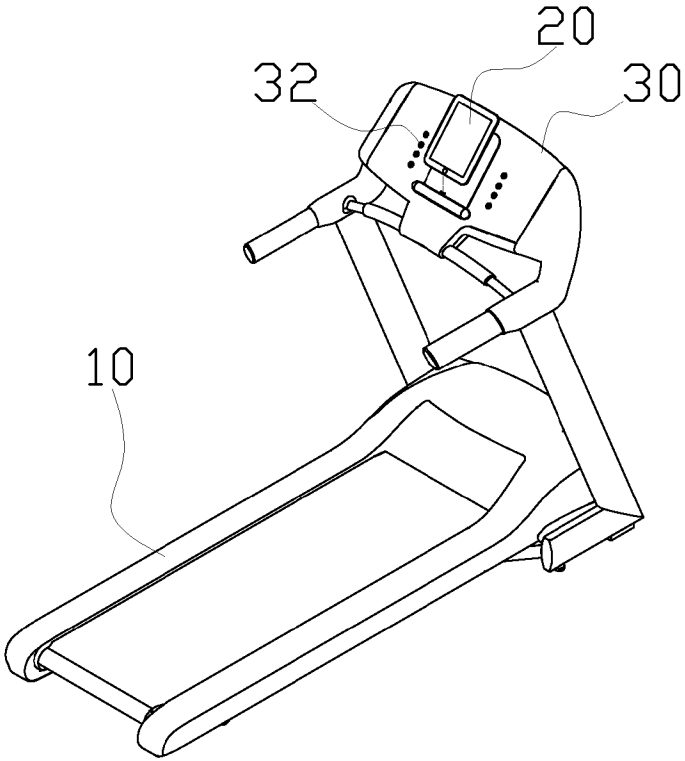
FIG. 3 is a schematic view of the portable electronic device as depicted in FIG. 1 and removed from the fixed electronic control panel for its use.

With reference to FIGS. 2 and 3 for a portable electronic device applied to an electric treadmill 10 in accordance with a preferred embodiment of the present invention, after the portable electronic device 20 obtains all personal related parameters of the user and plans the recommended fitness schedule, the portable electronic device 20 is connected to the fixed electronic control panel 30 of the electric treadmill 10. Now, the portable electronic device 20 will detect that the operating sport equipment is an electric treadmill 10, and then the electric treadmill 10 is operated and controlled by the portable electronic device 20 to carry out the recommended fitness schedule of the electric treadmill 10 and record the whole course of the user's exercise conditions and update the parameters. After the execution is completed, the portable electronic device 20 will set another recommended fitness schedule according to the new parameters for the exercise next time.

Of course, the present invention further comprises a charging circuit (not shown in the figure) installed on the fixed electronic control panel 30, such that after the charging circuit is connected to the portable electronic device 20, the portable electronic device 20 can be electrically charged.

After the recommended fitness schedule is set, or the other sport equipment is used, the user simply needs to remove the portable electronic device 20 from the fixed electronic control panel 30 and disconnect the portable electronic device 20 from the fixed electronic control panel 30. Now, the electric treadmill 10 will resume a general condition controlled by a basic control key 32, so that the normal use of the sport equipment by other users will not be affected.

Figure 4:
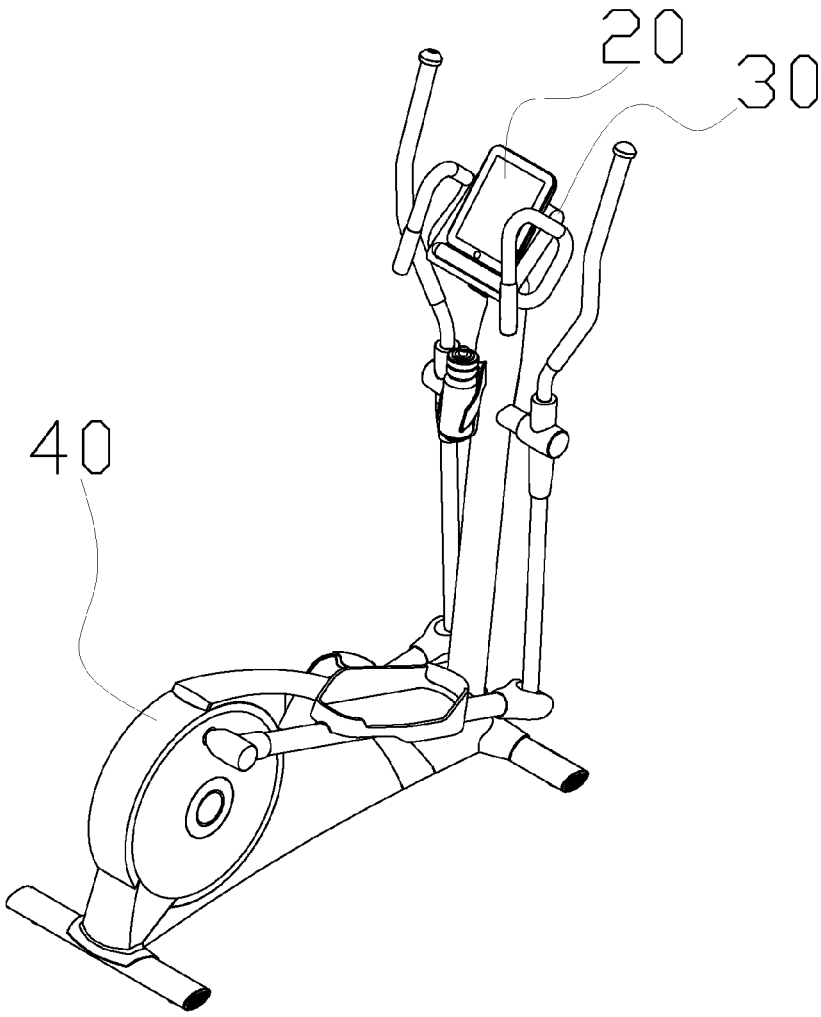
FIG. 4 is a schematic view of a portable electronic device installed to an electric elliptical trainer in accordance with a preferred embodiment of the present invention.
Figure 5:
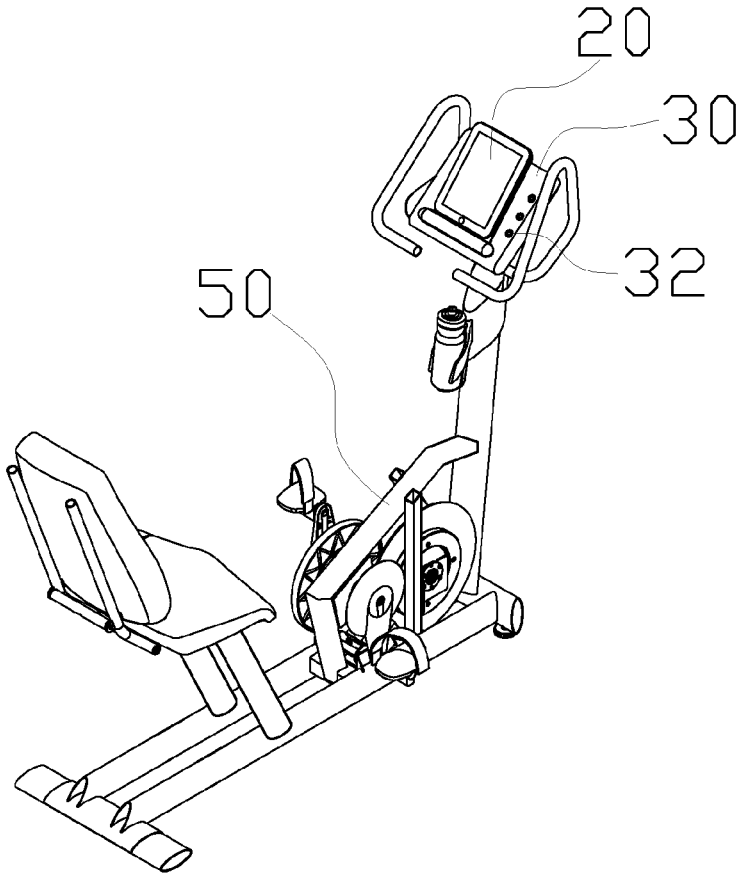
FIG. 5 is a schematic view of a portable electronic device installed to an electric exercise bike in accordance with a preferred embodiment of the present invention.

With reference to FIGS. 4 and 5 for a portable electronic device 20 of the present invention applied to an electric elliptical trainer 40 and an exercise bike 50 respectively and used together with the fixed electronic control panel 30, the effect and performance are same as those of the electric treadmill 10. In other words, the built-in program of the portable electronic device 20 can automatically determine the type of the sport equipment and its exercise mode, so as to provide various recommended fitness schedules for users to achieve the same exercise effects and purposes, even if the user uses different operating sport equipments.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A portable operation control panel structure of a sport equipment, comprising:

a portable electronic device, coupled to a fixed electronic control panel, and including an exercise plan and a driver program of the operating sport equipment built into the portable electronic device, such that a user can input personal basic data and a food list, and enter personal latest information anytime through a network supported by a cable or wireless technology, so as to plan a recommended fitness schedule suitable for a specific individual according to all parameters;

a fixed electronic control panel, installed on the sport equipment, and disposed in a special area of the portable electronic device, and having a basic control key for controlling an operation of the sport equipment, and an operating sport equipment;

whereby, after the portable electronic device and the fixed electronic control panel are coupled, the operating sport equipment is controlled by the portable electronic device to carry out the recommended fitness schedule, while the portable electronic device records the whole course of an exercise process and updates related personal parameters to set another recommended fitness schedule for an exercise next time.

2. The portable operation control panel structure of a sport equipment as recited in claim 1, wherein the portable electronic device and the fixed electronic control panel are coupled with each other via a cable or wireless transmission.

3. The portable operation control panel structure of a sport equipment as recited in claim 2, wherein the fixed electronic control panel includes a charging circuit for electrically charging the portable electronic device.

* * * * *